United States Patent [19]

Beisel

[11] Patent Number: 4,533,469

[45] Date of Patent: Aug. 6, 1985

[54] GRASS SEED FROM STEM REMOVER

[76] Inventor: Victor A. Beisel, Rte. 1, Box 26, Fargo, Okla. 73840

[21] Appl. No.: 569,248

[22] Filed: Jan. 6, 1984

[51] Int. Cl.[3] ..... B07B 1/28

[52] U.S. Cl. ..... 209/243; 209/315; 209/393; 209/415

[58] Field of Search ..... 209/315, 393, 394, 400, 209/288, 415, 243

[56] References Cited

U.S. PATENT DOCUMENTS

| | | | |
|---|---|---|---|
| 110,351 | 12/1870 | Follett | 209/393 |
| 141,917 | 8/1873 | Carpenter | 209/293 |
| 640,793 | 1/1900 | Murphy | 209/34 |
| 734,467 | 7/1903 | Martien | 209/394 |
| 1,760,877 | 6/1930 | McKinley | 209/393 |
| 1,956,507 | 4/1934 | Johnson | 209/394 |
| 2,011,365 | 8/1935 | Kuballe | 209/393 |
| 2,058,381 | 10/1936 | Lindgren | 209/394 |
| 2,156,716 | 5/1939 | Beckwith | 209/315 |
| 2,312,665 | 3/1943 | Moore | 209/393 |
| 2,416,008 | 2/1947 | Kerr | 209/393 |
| 2,554,416 | 5/1951 | Morrissey | 209/394 |
| 2,579,002 | 12/1951 | Johnson | 209/415 |
| 3,087,499 | 4/1963 | Carmichael, Jr. et al. | 209/288 |
| 3,087,618 | 4/1963 | Musschoot et al. | 209/393 |
| 3,147,321 | 9/1964 | Oswald et al. | 209/288 |
| 3,347,373 | 10/1967 | Dahlberg | 209/365 R |
| 3,425,553 | 2/1969 | Slovic | 209/415 |
| 3,837,490 | 9/1974 | Driebel et al. | 209/363 |
| 4,030,606 | 6/1977 | Smith et al. | 209/406 |
| 4,340,469 | 7/1982 | Archer | 209/363 |

*Primary Examiner*—Tim Miles

*Attorney, Agent, or Firm*—Harvey B. Jacobson

[57] ABSTRACT

An elongated, inclined sieve frame is provided and the frame includes a plurality of elongated transversely extending and transversely corrugated sheet metal sections arranged in laterally spaced parallel relation in an inclined plane extending lengthwise of the sieve frame. Each sheet metal section is substantially transversely straight throughout its transverse extent and corresponding portions of the corrugations of adjacent sections are disposed in parallel planes oppositely inclined relative to the inclination of the first-mentioned plane. The sieve frame is suspended at its opposite ends through the utilization of elastic suspension members and stricture is provided and operatively connected to the longitudinal mid-portion of the frame to impart omnidirectional vibration thereto in a vertical plane normal to the first-mentioned plane and the aforementioned parallel planes. Further, structure is provided for supplying the upper portion of the sieve frame and the corrugated sheet metal sections supported therefrom with a generally constant rate supply of grass seed supporting grass stalks.

5 Claims, 8 Drawing Figures

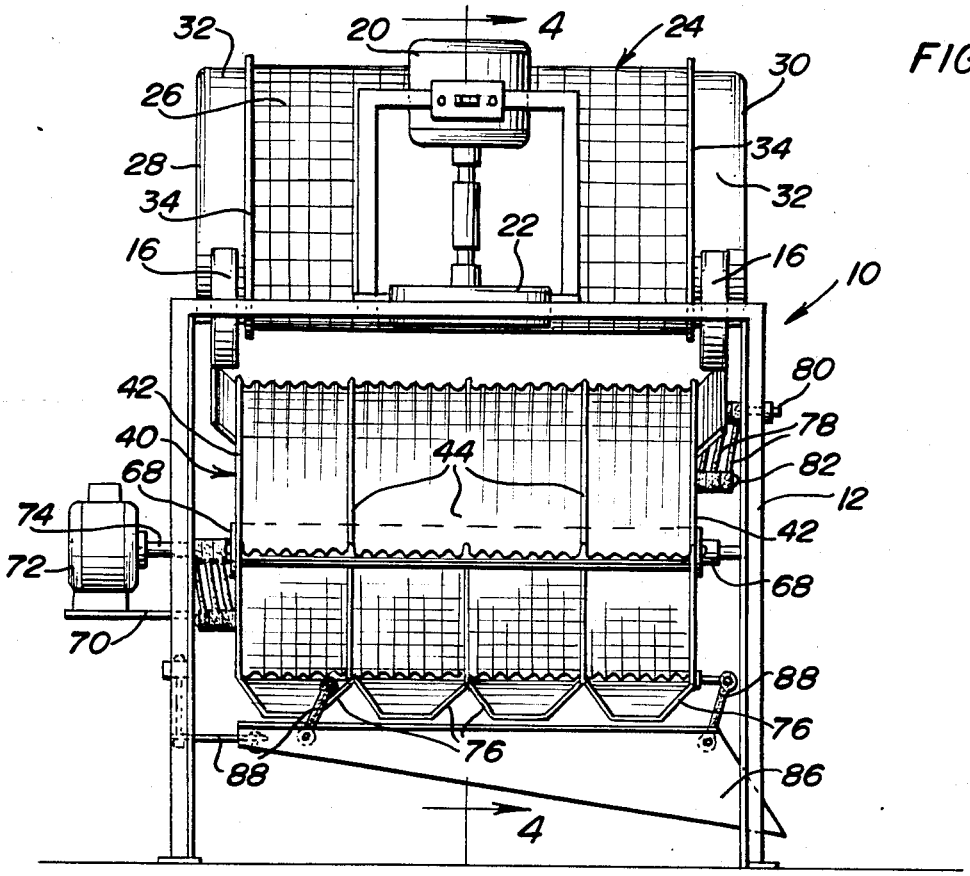
FIG. 3
FIG. 6
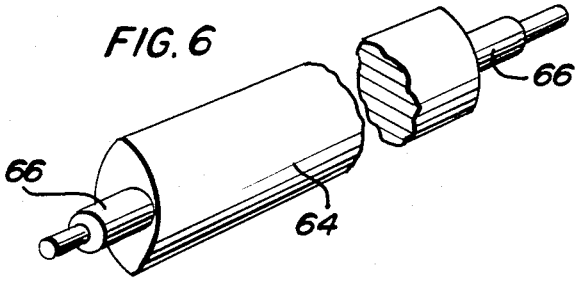
FIG. 7
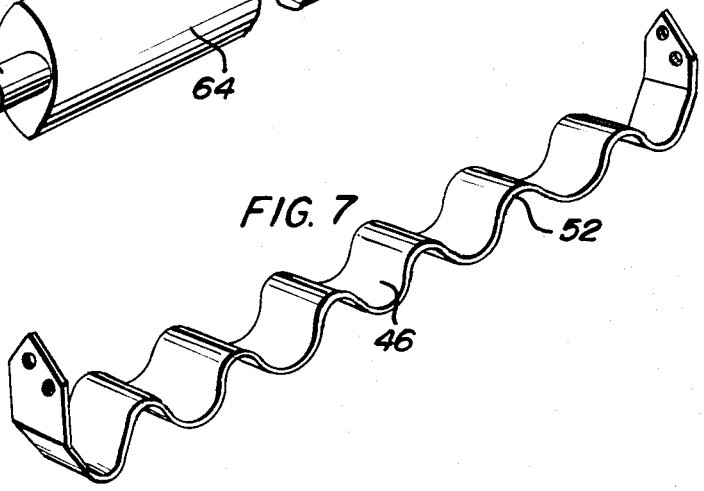
FIG. 8
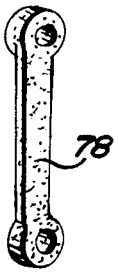

GRASS SEED FROM STEM REMOVER

BACKGROUND OF THE INVENTION

Various forms of grasses including chaffy seed grasses are becoming popular for grazing and large scale seeding operations for grasses which include chaffy grass seed are relatively expensive due to the extensive seed processing operations which must be performed in order to produce a seed product which is clean, substantially pure and includes minimum seed damage.

Present steps to process chaffy seed grasses include the use of a hammer mill to separate the seed from the grass stem and subsequent seed cleaning treatment to debeard and deglume the seed. However, hammer mills cause high percentage of seed damage and present apparatuses utilized to debeard and deglume seed are only minimumly effective and tend to cause greater damage to the seed.

Accordingly, a need exists for apparatus by which seed may be more efficiently removed from grass stems and debearded and deglumed. The present invention is concerned primarily with more efficient removing of the seed from the grass stems with minimum damage to the seed.

Examples of previously known devices including some of the general structural and operational features of the instant invention are disclosed in U.S. Pat. Nos. 640,793, 2,011,365, 2,416,008, 3,087,618, 3,347,373, 3,837,490, 4,030,606 and 4,340,469.

BRIEF DESCRIPTION OF THE INVENTION

The instant invention includes an elongated inclined sieve frame incorporating a plurality of elongated transversely extending and transversely corrugated side-by-side sheet metal sections arranged in laterally spaced parallel relation. Each of the sheet metal sections is substantially transversely straight throughout its transverse extent and the corresponding portions of the corrugations of adjacent sections are disposed in parallel planes oppositely inclined relative to the inclination of the sieve frame. In addition, the sieve frame includes upper and lower sets of corrugated sheet metal sections and the corrugated sheet metal sections of the lower set are spaced closer together. Further, a rotating wire drum structure is journaled above the inlet end of the elongated sieve frame and is openable to receive cut seed-supporting grass stems or stalks therein. Rotation of the drum serves to discharge seed-supporting grass stems down onto the sieve at a substantially constant rate thereby enabling efficient operation of the vibratory sieve.

The main object of this invention is to provide an apparatus which will be capable of efficiently removing seed from grass stems and green strips.

Another object of this invention is to provide an apparatus of the above referred to type and including a vibratory sieve of a construction operable to remove grass seeds from grass stems and green strips in a manner maintaining damage to the grass seeds minimal.

Still another object of this invention is to provide a grass seed remover whose constuction enables it to efficiently remove various different types of bearded seeds from grass stems and green strips.

Another object of this invention is to provide an apparatus in accordance with the preceding objects and which may be adjusted according to the type and moisture content of the grass stems and seeds being processed.

A final object of this invention to be specifically enumerated herein is to provide an apparatus for separating grass seeds from stems and green strips and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a rear elevational view of the apparatus illustrated in FIGS. 1 and 2;

FIG. 6 is a fragmentary perspective view of the motor driven vibrator shaft portion of the apparatus;

FIG. 7 is a perspective view of one of the elongated transversely corrugated sheet metal sections or strips of the apparatus; and FIG. 8 is a perspective view of one of the elastic suspension members utilized for suspension of the sieve assembly of the apparatus as well as the discharge chute portion of the apparatus.

DETAILED DESCRIPTION OF THE INVENTION

Figure 1:
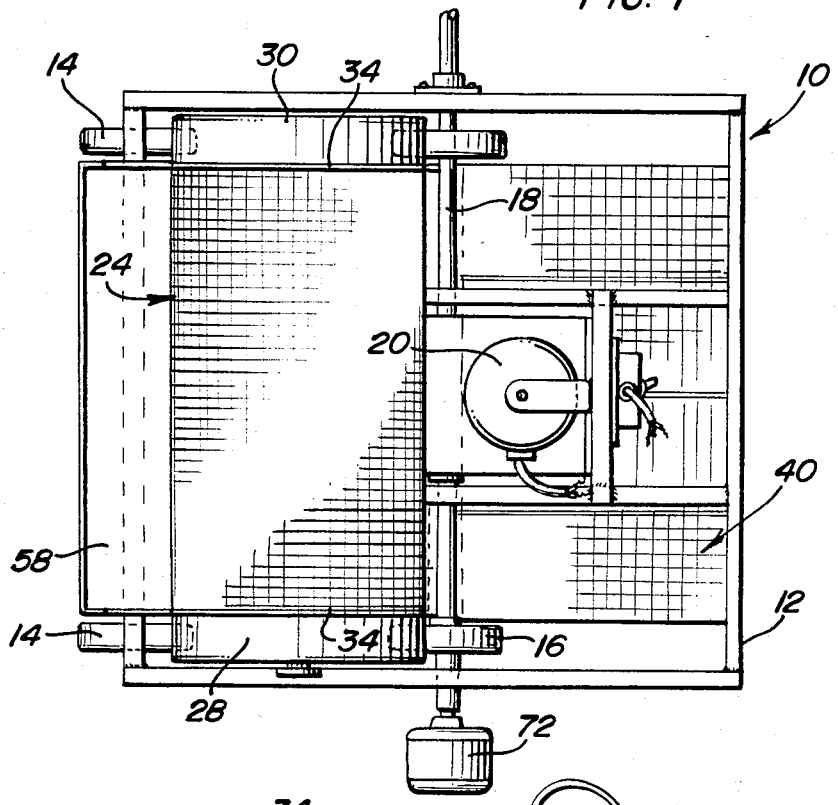
FIG. 1 is a top plan view of the grass stem and seed processing apparatus of the instant invention.

Referring now more specifically to the drawings the numeral 10 generally designates a grass seed removing apparatus including an upstanding frame 12 from whose upper portion front and rear pairs of transversely aligned rollers or wheels 14 and 16 are journaled. The rollers 16 are mounted on a transverse shaft 18 for rotation therewith and the shaft 18 is driven by an electric motor 20 through a simple speed or variable speed reduction assembly 22.

A cylindrical drum referred to in general by the reference numeral 24 is provided and includes a wire mesh cylindrical body 26 and opposite end walls 28 and 30. The end walls 28 and 30 include cylindrical portions 32 rollingly engaged with the wheels 14 and 16 and radial flange portions 34 on the remote sides of which the wheels 16 are disposed. One of the end walls 28 and 30 is openable in order to load the drum 24.

The frame 12 also supports an elongated sieve assembly referred to in general by the reference numeral 40 including rigidly interconnected opposite side walls or plates 42 extending longitudinally thereof as well as tranversely spaced longitudinally extending partition walls or plates 44 disposed between the side walls 42. A plurality of elongated transversely corrugated strip members or sections 46 are transversely spaced apart along longitudinally extending upper and lower reaches 48 and 50 of sieve assembly 40. Strip members 46 are secured between each of the side walls 42 and the adjacent partition wall 44 and between each pair of adjacent partition walls 44. The strip members or sections 46 are transversely corrugated as at 52 and the reaches 48 and 50 are downwardly inclined toward the discharge end 54 of the sieve assembly 40. The upper inlet end 56 of the sieve assembly 40 has the lower end of an inclined chute 58 registered therewith and the chute 58 underlies that portion of the drum 24 which is not in vertical registry with the upper end of the upper reach 48 of strip members 46.

Corresponding portions of adjacent strip members 46 in each reach 48 and 50 thereof are disposed in parallel planes oppositely inclined relative to the inclination of the sieve assembly 40. Further, longitudinal central portions of the opposite side walls 42 have openings 60 formed therein in which the opposite ends of a cover tube or pipe 62 are secured. An eccentrically weighted shaft 64 extends through the tube or pipe 62 and includes diametrically reduces end portions 66 journaled from journal blocks 68 mounted on the outer sides of the side walls 42 in registry with the openings 60. In addition, the frame 12 includes a horizontal support 70 on the right side thereof which mounts an electric motor 72 whose rotary output shaft 74 is drivingly coupled to the adjacent end of the shaft 64.

The sieve assembly 40 includes a plurality of inclined upwardly opening troughs 76 which underlie the lowermost reach of strip members 46 and each opposite side of the upper end of the sieve assembly 40 is supported from the frame 12 by a plurality of elongated elastic members 78 having their upper ends mounted to the frame 12 as at 80 and their lower ends anchored relative to the sieve assembly 40 as at 82. Similar sets of elongated elastic members 83 are utilized to support opposite sides of the lower end of the sieve assembly 40 from the rear of the frame 12. It will be noted that both the front and rear end portions of the frame 12 include vertically spaced apertures 84 by which the upper ends of the elastic members 78 and 83 may be vertically adjusted so as to vary the inclination of the sieve assembly 40.

Figure 2:
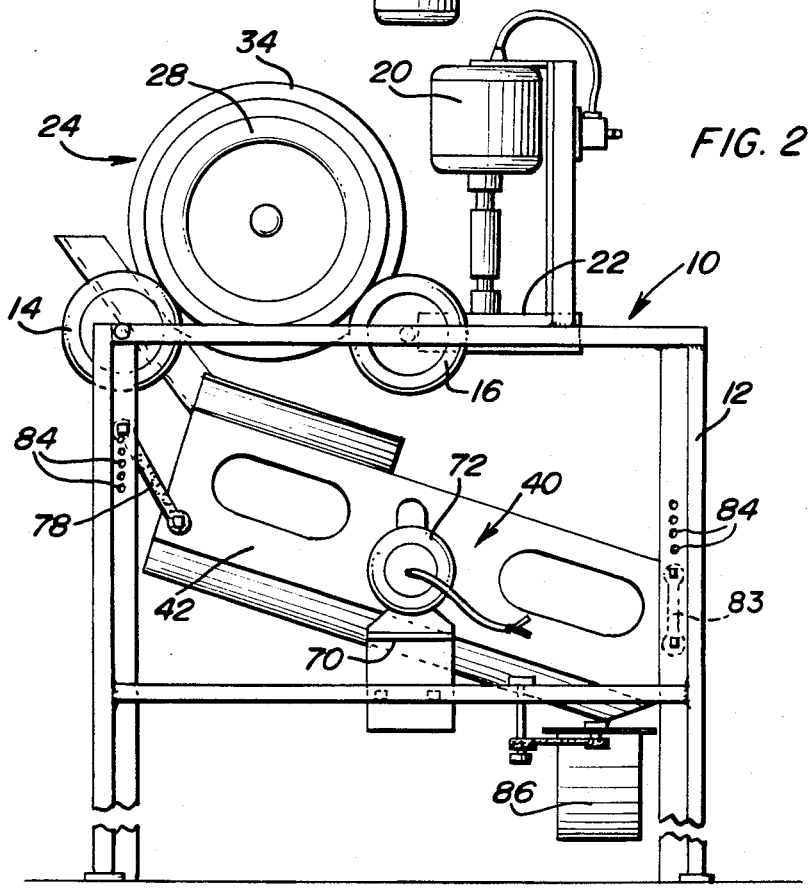
FIG. 2 is a right side elevational view of the assemblage illustrated in FIG. 1.
Figure 4:
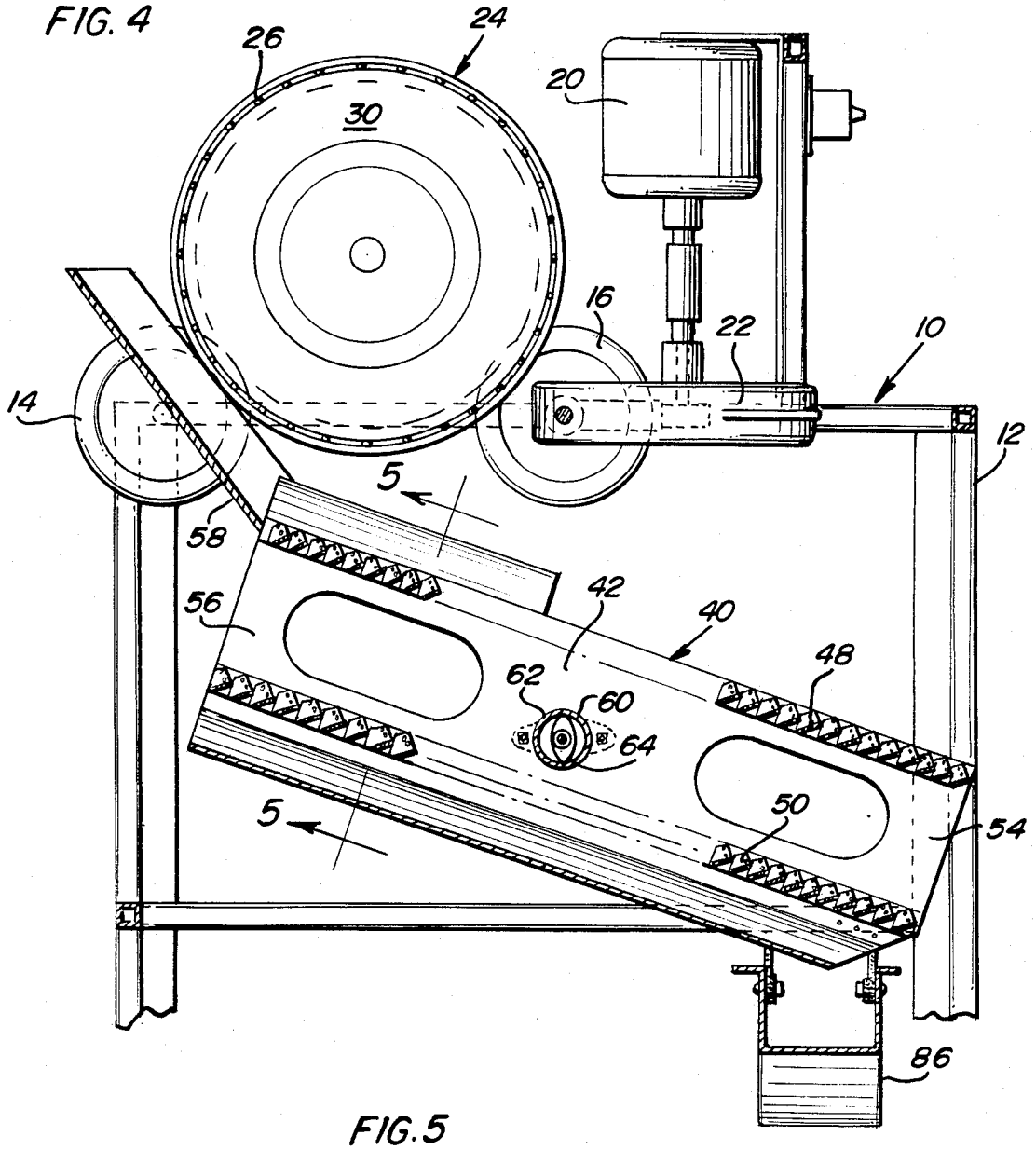
FIG. 4 is an enlarged fragmentary vertical sectional view taken substantially upon the plane indicated by the section line 4—4 of FIG. 3.
Figure 5:
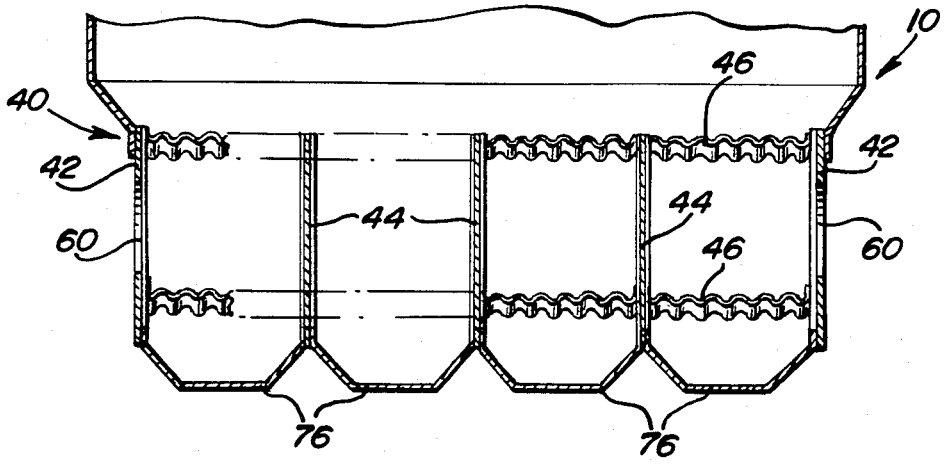
FIG. 5 is a fragmentary vertical sectional view taken substantially upon the plane indicated by the section line 5—5 of FIG. 4.

From FIGS. 2, 3 and 4 of the drawings it will be seen that an inclined combined collection and discharge chute 86 is also suspended from the frame 12 and the lower end of the asembly 40 through the utilization of additional elongated elastic members 88 and, accordingly, the chute 86 is also supported for vibration relative to the frame 12 as a result of operation of the motor 72.

The shaft 64 substantially parallels the strip members 46 and accordingly, the sieve assembly 40 is vibrated in an omnidirectional manner within a plane disposed normal to the sieve members 46. Further, although the motor 72 is supported from the frame 12, the rotary output shaft 74 thereof is connected to the shaft 64 through flexible drive member such as a rubber tube or the like of sufficient length so as not to interfere with vibration of the assembly 40.

In operation, cut seed bearing grass stalks are deposited into the drum 24 and the motor 20 is actuated along with the motor 72. During operation of the motor 20 the drum 24 slowly rotates and discharges seed bearing cut grass stems therefrom down into the sieve assembly 40. The upper reach 48 of strip members 46, as a result of vibration of the sieve assembly 40, removes the major stem portions of the cut grass from the seed bearing short stem and green strips. The major stem portions fall from the lower end of the upper reach 48 and the short seed bearing grass stems and green stips fall through the first reach 48 onto the second reach of strip members 46. The second reach of strip members 46 are more closely spaced and serve to remove the seeds from the short stems and green strips being vibrated on the lower reach 50. The removed seeds fall downwardly between the strip members 46 and into the troughs 76 for movement downwardly there along. The removed seed is discharged from the lower ends of the troughs 76 into the inclined chute 86 and the collected seeds are then discharged from the lower end of the chute 86 into a suitable receptacle (not shown) therefor.

The short stem and green strip portions vibrated by the lower reach 50 of strip members 46 move downwardly along the reach 50 and are discharged from the lower end thereof.

The incline of the sieve assembly 40 is approximately 20° and the strip members 46 are substantially oppositely inclined approximately 20° relative to the horizontal.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus for removing grass seeds from grass stalks and stems, said apparatus including an elongated, inclined sieve frame, said sieve frame including a plurality of sets of individual elongated transversely extending and transversely corrugated sheet metal sections with the sections of each set arranged in laterally spaced parallel relation in an inclined plane extending lengthwise of said sieve frame, each of said sections being substantially transversely straight throughout its transverse extent and corresponding portions of the corrugations of adjacent sections being disposed in parallel planes oppositely inclined relative to the inclination of the first-mentioned plane, means operative to vibrate said sieve frame, said sieve frame including at least three laterally spaced edge upstanding plates extending longitudinally thereof, each set of corresponding sections being disposed between one pair of adjacent plates and secured at their opposite ends to the corresponding plates, a plurality of elongated upwardly opening inclined troughs extending longitudinally along said sieve frame beneath the latter with each trough including opposite longitudinal marginal portions mounted from the lower marginal portions of a corresponding pair of adjacent plates and each set of corrugated sections registered with and disposed above a corresponding trough, the opposite sides of the upper and lower ends of said sieve frame each being supported from the lower ends of a plurality of elongated flexible elastic members, a support frame, the upper ends of said elastic members being anchored relative to adjacent portions of said support frame, the upper ends of said elastic members supporting at least one end of said sieve frame and said support frame including means operative to vertically adjust the elevation at which the upper ends of the last mentioned elastic members are anchored relative to said support frame, said elastic members supporting said sieve frame from said support frame for omni-directional vibration of said sieve frame in a vertical plane extending longitudinally of said sieve frame, said means operative to vibrate said sieve frame including an eccentrically weighted shaft space centrally intermediate the opposite ends of said sieve frame and journalled from at least two said plates for rotation about a horizontal axis extending transversely of said frame, and motor means drivingly coupled to said shaft for rotating the latter.

2. The apparatus of claim 1 wherein said sieve frame includes vertically spaced superposed inclined reaches of laterally spaced corrugated sheet metal sections, with each reach of corrugated sections comprising a plurality of sets of corrugated sections, the upper and lower reaches of said corrugated sections being secured to the upper and lower marginal portions, respectively, of the corresponding adjacent plates, the spacing between adjacent corrugated sheet metal sections of the lower reach of sections being less than the spacing between adjacent sheet metal sections of the upper reach of sheet metal sections.

3. The apparatus of claim 1 including two laterally spaced pairs of aligned roller means journaled from an upper portion of said support frame above the upper end of said sieve frame, a cylindrical wire mesh container closed at its opposite ends and cradled between and journaled from said rollers, means driving one part of said rollers, one end of said cylindrical wire container including means for admitting seed supporting grass stems and stalks therein.

4. The apparatus of claim 1 including supply means operative to supply cut seed supporting grass stalks to said sieve frame at a substantially constant rate.

5. The apparatus of claim 4 wherein said supply means includes a horizontal cylindrical wire container supported in elevated position above the upper end of said inclined sieve frame for rotation about the longitudinal center axis of said container, and means driving said container at a slow rotational speed.

* * * * *